United States Patent [19]

Jizaimaru et al.

[11] 4,272,352

[45] Jun. 9, 1981

[54] ELECTRODE COMPARTMENT

[75] Inventors: Tanzo Jizaimaru, Shikawatashi; Hideya Tanaka, Chiba; Yasuo Sajima, Yokohama, all of Japan

[73] Assignee: Asahi Glass Company, Ltd., Tokyo, Japan

[21] Appl. No.: 45,932

[22] Filed: Jun. 6, 1979

[30] Foreign Application Priority Data

Jun. 14, 1978 [JP] Japan ..... 53-70993

[51] Int. Cl.[3] ..... C25B 9/02; C25B 9/04; C25B 15/08

[52] U.S. Cl. ..... 204/279; 204/269; 204/288

[58] Field of Search ..... 204/279, 288, 289, 255-258, 204/263-266, 269-270, 275-278, 286

[56] References Cited

U.S. PATENT DOCUMENTS

| | | | |
|---|---|---|---|
| 4,056,458 | 11/1977 | Pohto et al. | 204/289 X |
| 4,065,376 | 12/1977 | Whyte et al. | 204/263 |
| 4,111,779 | 9/1978 | Seko et al. | 204/255 |
| 4,149,952 | 4/1979 | Sato et al. | 204/266 X |

*Primary Examiner*—Aaron Weisstuch
*Assistant Examiner*—D. H. Valentine
*Attorney, Agent, or Firm*—Oblon, Fisher, Spivak, McClelland & Maier

[57] ABSTRACT

An electrode compartment is a part of a filter press type electrolytic cell for electrolyzing an alkali metal chloride. The electrode compartment comprises lower, upper and side frames to form an electrolyzing chamber, and current lead bars which are inserted from the bottom of the lower frame in the vertical direction to be parallel to lifting flow of an electrolyte and the electrode being mechanically held through fitting means on the lead bars in the electrolyzing chamber.

4 Claims, 10 Drawing Figures

ELECTRODE COMPARTMENT

BACKGROUND OF THE INVENTION

1. Field of the Invention

The present invention relates to a structure of an electrode compartment in a filter press type electrolytic cell for electrolyzing an alkali metal chloride.

2. Description of the Prior Arts

An electrode compartment comprises a frame having means for feeding an electrolyte, a frame for discharging an electrolyzed product and electrode assembly of an electrode and current lead bars for electrically connecting the electrode to a power source (hereinafter referring to as lead bars). The ends of the lead bars should be projected through the frame to electrically connect to the power source.

On the other hand, it is preferable to reduce the width of the frames for forming the electrode compartment in view of reducing a space for setting the apparatus; reducing a weight of the electrolytic cell; reducing cost for the apparatus; and increasing efficiency in the same size of the electrolytic cell.

In the electrode compartment holding the above-mentioned electrode assembly in the frames, it is necessary to have the structure for removing, speedily, the gas generated by the electrolysis, out of the electrode compartment so that the increase of the electrolytic voltage caused by the gas is prevented.

Various arrangements of the lead bars and the flow of the electrolyte can be considered to attain said purpose. It is considered to arrange the lead bars to be substantially perpendicular to the lifting flow of the electrolyte in the electrode compartment for feeding the electrolyte through the lower frame and discharging the electrolyzed product through the upper frame.

However, it is usual that the frames have a structure having longer horizontal length for said electrode compartment. When the lead bars are formed to be economical (the material for the lead bars is expensive), the sectional area of the lead bar for passing the current is small. The length of the lead bars for passing the current is long when the lead bars are set in horizontal direction (structure of frames having longer horizontal length). Accordingly, a voltage drop in the lead bars is large and the efficiency of the electrolytic cell is lowered, disadvantageously.

The inventors have studied to obtain a structure of an electrode compartment from which the gas generated can be removed speedily, without increasing a width of the frames, in view of arrangements of the lead bars, shapes of the lead bar and assembling of the lead bars.

SUMMARY OF THE INVENTION

The present invention is to provide an electrode compartment comprising lead bars for electrically connecting an electrode to a power source and an electrode held on the lead bars in an electrolyzing chamber surrounded by frames, means for feeding an electrolyte in a lower frame and means for discharging an electrolyzed product in an upper frame to result in lifting flow of the electrolyte in the electrolyzing chamber, wherein the lead bars are inserted through the bottom of the lower frame in the vertical direction to be substantially parallel to the lifting flow of the electrolyte in the electrolyzing chamber and the electrode is mechanically held by the lead bars through fitting means mounted on the lead bars to electrically connect the lead bars to the electrode.

In accordance with the structure of the electrode compartment, the disadvantage of the voltage drop can be overcome and the electrolyzed product including the gas can be lifted speedily, to the upper frame because the lead bars are inserted from the bottom of the lower frame. (In the case inserting the lead bars in the horizontal direction, the electrolyzed product including the gas is not smoothly lifted because of reducing the gas lifting effect by the disturbance of the lead bars).

In accordance with the present invention, the increase of the electrolytic voltage caused by the residence of the gas can be prevented and a space between the electrodes can be easily adjusted when a pair of electrodes are held at both sides of the lead bars and damage of the lead bars in disassembling operation can be prevented in the disassembling for the repair, since the electrodes are held through the fitting means.

The electrode compartment can be an anode compartment equipped with an anode and a cathode compartment equipped with a cathode. The anode compartments and the cathode compartments are alternatively arranged and membranes such as ion exchange membranes or asbestos diaphragms are respectively disposed between the adjacent compartments and the frames for the compartments are fastened to form a filter press type electrolyte cell.

In the structure of the present invention, a gasket can be inserted for holding the membrane to improve the packing effect. This is the preferable embodiment.

In the structure of the present invention inserting the lead bars from the bottom of the lower frame in the vertical direction, the bus bars are disposed below the electrolytic cell and accordingly, it is necessary to consider the prevention of leakage of the electrolyte for higher degree than that of the structure inserting the lead bars in the horizontal direction.

In accordance with the experiments, it is preferable to use a gasket having linear projection which is deformed by fastening, on the surface of the gasket. This is one embodiment of the present invention. When an ion exchange membrane is used as the membrane, it is preferable to dispose a spacer between the membrane and the electrode to prevent the contact of the membrane with the electrode.

DETAILED DESCRIPTION OF THE PREFERRED EMBODIMENTS

Figure 1:
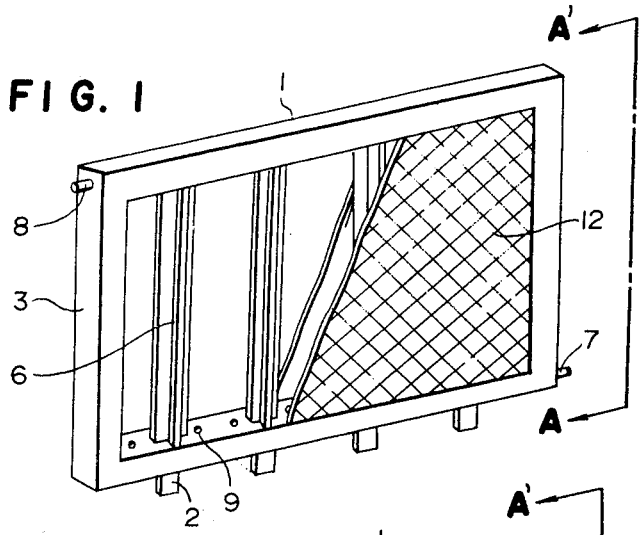
FIGS. 1 and 2 are respectively schematic views of embodiments of the electrode compartment of the present invention.
Figure 2:
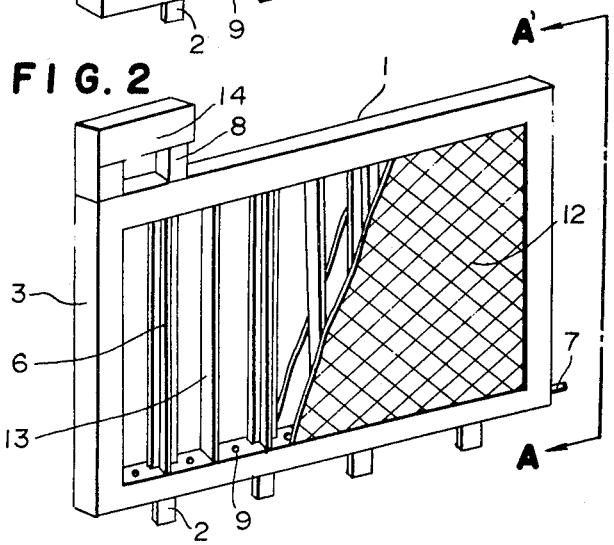

Referring to FIGS. 1 to 8, the structure of the electrode compartment will be illustrated.

As shown in FIGS. 1 to 8, the frames (1) for forming the electrode compartment of the present invention is preferably rectangular shape having a chamber in the central part. In this structure, means for feeding an electrolyte (4) is formed at the lower frame and means for discharging an electrolyzed product (5) is formed at the upper frame. The feeding means is a means for feeding the electrolyte from outside of the frames for an electrolytic cell into the inner part of the frames. The discharging means is a means for discharging an electrolyzed product from the chamber in the frames out of the frames. For example, such means can be formed by forming holes in the frame. It is preferable to form a hollow frame (1') which forms a passage for feeding the electrolyte into the electrolyzing chamber and discharging the electrolyzed products whereby the compact frames having the feeding and discharging function can be provided and a weight of the frames can be reduced. That is, at least lower frame and upper frame should have the hollow structure. On the lower frame, it is necessary to form an inlet (7) for feeding an electrolyte into the hollow part of the lower frame and holes (9) for feeding the electrolyte from the hollow part of the lower frame into the electrolyzing chamber. On the other hand, on the upper frame, it is necessary to form holes (10) for discharging the electrolyzed products from the electrolyzing chamber into the hollow part of the upper frame and to form an outlet (8) for discharging the electrolyzed products from the hollow part of the upper frame.

The electrode compartment has a pair of side frames (3) which are preferably hollow frames. The lead bars (2) for feeding current from bus bars to the electrode are inserted from the bottom of the electrode compartment through the means for feeding an electrolyte (4) into the electrolyzing chamber to reach near the upper frame. The lead bars (2) and the electrode (12) are electrically and mechanically connected by the fitting means (6). If desired, the lead bars (2) can reach to the upper frame. However, the holes (10) for discharging the electrolyzed products which are formed on the lower surface of the upper frame cause non-uniform distribution and the lead bars reduce the effective area of the lower surface of the upper frame. Accordingly, it is usually disadvantageous to reach the lead bars to the lower surface of the upper frame.

Figure 6:
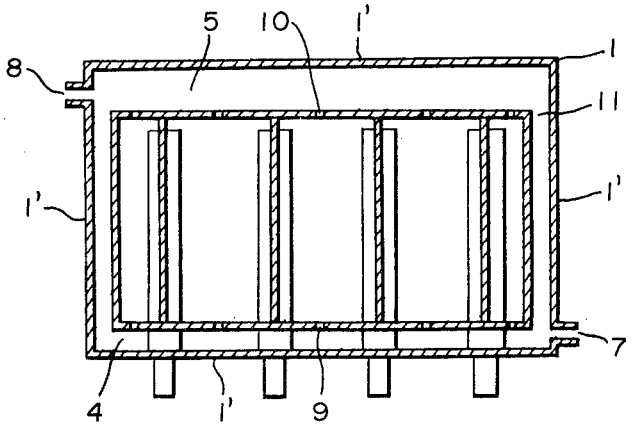
FIG. 6 is a sectional view taken along the line A–A' of FIG. 1 but in this case, only a part of the fitting means contacts with the upper hollow frame.
Figure 7:
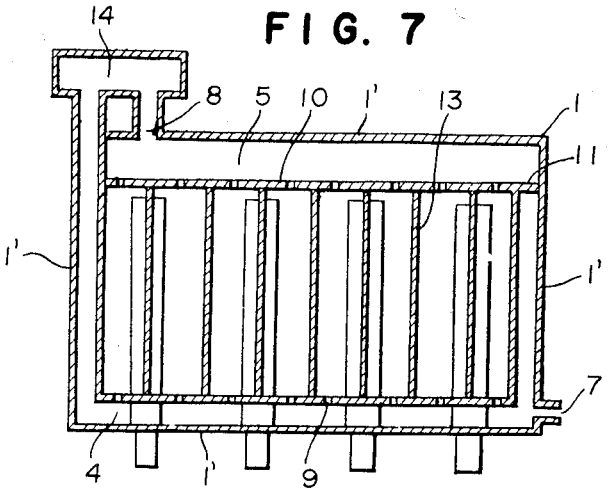
FIG. 7 is a sectional view taken along the line A–A' of FIG. 2 but in this case, only a part of the fitting means contacts with the upper hollow frame.

FIGS. 6 and 7 are sectional views of the electrode compartment in which the lead bars (2) are not directly contacted with the upper frame, but only part of the fitting means contacted with the upper frame and the lead bars are supported by the fitting means (6) having each hollow (15) fitted to each lead bar. FIG. 6 corresponds to FIG. 3 except the lead bars (2) do not reach to the upper frame. FIG. 7 corresponds to FIG. 4 except the lead bars (2) do not reach to the upper frame.

Figure 8:
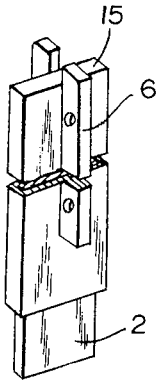
FIGS. 8, 9 and 10 are respectively partial schematic views of lead bars on which a fitting means is fitted.
Figure 10:
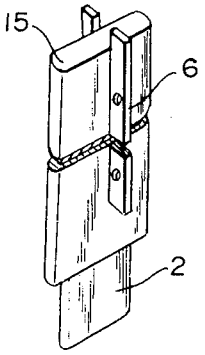

The fitting means (6) used in the embodiments of FIGS. 6 and 7 can have the structures shown in FIGS. 8 and 10.

In the feature of FIG. 8, the electrically connecting strip having holes contacted with the fitting means surrounding the lead bar, is slightly projected upwardly so that only the projected part of the electrically connecting strip can contact with the upper frame.

The feature of FIG. 10 corresponds to that of FIG. 8 except that the fitting means (6) has round corner sectional view.

Figure 9:
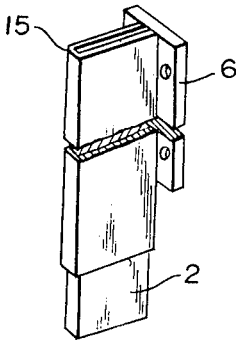

In the feature of FIG. 9, the electrically connecting strip is attached to the side of the fitting means surrounding the lead bar which is not projected upwardly.

These holes in the electrically connecting strip imparts effect of communicating electrolyte horizontally across said strip.

In accordance with the features of FIGS. 6 and 7, the flow passed from the electrolyzing chamber to the upper frame is not disturbed by the lead bars (2) as described above.

Figure 3:
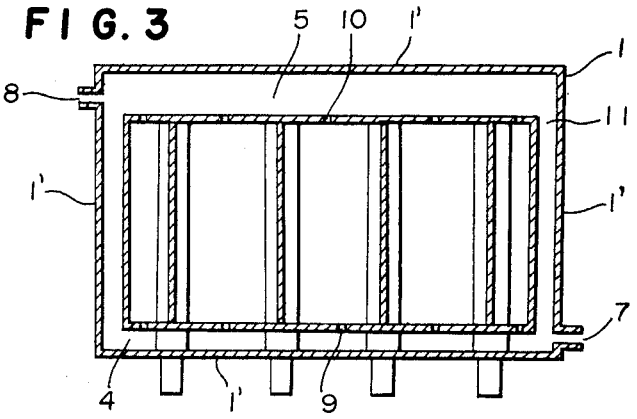
FIG. 3 is a sectional view taken along the line A–A' of FIG. 1.
Figure 4:
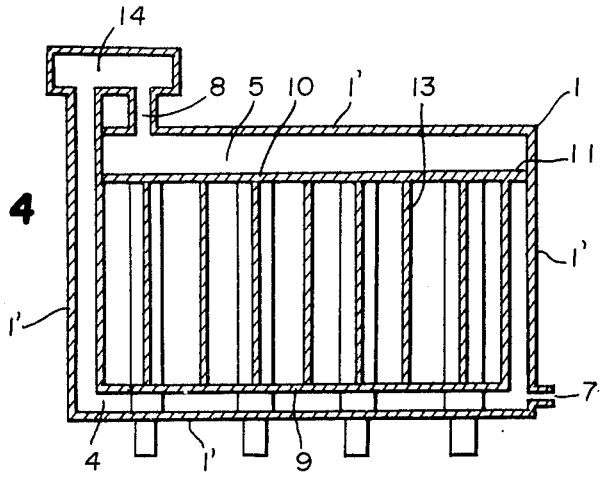
FIG. 4 is a sectional view taken along the line A–A' of FIG. 2.

In the structure of the electrode compartment, if desired, it is possible to open the upper ends (11) of the hollow side frames as shown in FIG. 3 whereby the electrolyte at the upper frame is fed through the hollow side frames to the hollow part of the lower frame to recycle the electrolyte into the electrolyzing chamber. However, in usual, the upper end (11) of one hollow side frame is closed as shown in FIG. 4, whereby the electrolyzed products are discharged through the outlet (8) and a gas is separated in a gas-liquid separator (14) connected to the outlet (8). The separated solution is fed through the open upper end of the other hollow side frame to recycle into the electrolyzing chamber. The latter structure is preferable by the following reason.

In an industrial electrolytic cell, many electrode compartments having said structure are arranged. Usually, concentrations of the solutions discharged from these electrode compartments are not always the same, but are different for certain degrees. It is not preferable to recycle the solutions having different concentrations in view of the operation for the electrolytic cell having many electrode compartments. Accordingly, it is preferable to collect the solutions containing the gas discharged from these electrode compartments in one or more gas-liquid separators, whereby the uniform concentration is given at the gas-liquid separation. The solution having uniform concentration is divided into a plurality of the electrode compartments in the recycling system. Because of the above-mentioned reason, when the electrolytic cell is operated to provide substantially uniform concentration of the solutions discharged from many electrode compartments, the upper ends (11) of the hollow parts of side frames can be opened to recycle each solution for each electrode compartment.

The substance of the frames should be anticorrosive to the solution and the gas contacted with the surfaces of the frames. For example, in an electrolytic cell for an electrolysis of NaCl the frames for the anode compartment should be made of a substance which is chlorine resistant such as titanium and titanium plated metal. The frames for the cathode compartment should be made of a substance which is alkali resistant such as iron, stainless steel, and iron or stainless steel plated metal.

The lead bar is a long plate which holds the electrode and which passes the current between a power source and the electrode. The lead bars are arranged so that the longitudinal direction of the lead bars are substantially in parallel to the flow of the solution in the electrolyzing chamber. For example, the lead bars are arranged in parallel to the side frames of the electrode compartment. One end of the lead bar is downwardly projected from the bottom of the lower frame and is connected to the bus bar for feeding the current.

The lead bars are arranged in parallel to the flow of the solution. Since the shape of the lead bar is a strap plate shape, the electrical connection to the fitting means (6) can be advantageously given in comparison with the electrical connection to a round rod type lead bar. When a round rod type lead bar is used, the electrical connection to a fitting means can not be effectively given even though the below mentioned method is employed.

The substance of the lead bar should have high electric conductivity and durable to the solution and the gas with which the lead bar is contacted. A substrate prepared by coating an anticorrosive substance on an electric conductive substance can be used. For example, an anode lead bar can be substrates prepared by coating a chlorine resistant metal such as titanium and platinum on a substrate made of an electric conductive metal such as copper and aluminum.

On the other hand, a cathode lead bar can be substrates prepared by coating an alkali resistant metal on a substrate made of a metal such as copper and aluminum.

As described above, it is preferable that the anticorrosive metal formed on the electric conductive metal substrate has a specific uniform thickness. Accordingly, the lead bar is preferably a clad substrate. In order to prepare such lead bar, the electric conductive metal is covered by the anticorrosive metal by the prior art methods such as a blacksmith welding method, a brazing method, a forging method, a surface coating method and an explosive press bonding method etc. The lead bar is a long plate as described above. Accordingly, a hot diffusion press bonding method is preferable in view of excellent fabrication, excellent bonding property between the electric conductive metal and the anticorrosive metal and economy.

In the hot diffusion press bonding method employed in the present invention, two kinds of metals such as copper and titanium or copper and stainless steel are placed in vacuum of lower than $10^{-2}$ mmHg, and they are heated at about 950° C.–1000° C. to cause diffusion of metal atoms and molecules and compressed under a pressure of 1 kg/mm$^2$. Thus, the anticorrosive metal having uniform thickness can be formed on the electric conductive substrate in the resulting lead bar. Accordingly, the lead bar having excellent size stability can be obtained.

As described above, a lead bar having a desired characteristic and a desired shape can be obtained by the hot diffusion press bonding method.

The electrode used in the present invention can be a metal electrode which has high electric conductivity and is anticorrosive to the solution and the gas with which the electrode is contacted. For example, the anode can be a substrate made of one of platinum group metals, titanium, platinum group metal coated titanium. The cathode can be iron and stainless steel substrate.

The shape of the electrode can be plate, net and lattice shape. It is preferable to be a net shape in view of preventing an adhesion of the gas generated by the electrolysis, on the electrode and maintaining uniform current density.

In accordance with the present invention, the electrode is fitted on the lead bars by the fitting means. The fitting means are used for electrically connecting the lead bars to the electrode. When the structure of the electrode is to form a pair of electrode surfaces which face each other through the lead bars, the gap between the electrodes should be adjusted depending upon variation of the condition of the electrolysis. In accordance with the present invention, the space between the electrodes can be easily adjusted by selecting a shape and a size of the fitting means even though the thickness of the lead bar is constant. That is, such fitting means are fitted in the longitudinal direction of the lead bars and the fitting means are welded on the surface of the electrode to attain said purposed.

It is preferable to dispose suitable number of reinforcing means (13) between the lead bars. In this case, the substance of the reinforcing means can be the same kinds of the fitting means. The shape of the reinforcing means is not critical and preferably is thin plate.

When such reinforcing means are mounted on a pair of the electrodes by welding or like, the pair of the electrodes are mechanically fixed to prevent vibration or bending on the electrodes against hydraulic pressure etc.

Figure 5:
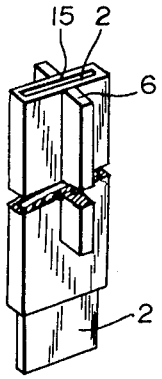
FIG. 5 is a partial schematic view of a lead bar on which a fitting means is fitted.

As shown in FIG. 5, the shape of the fitting means can be the cross sectional shape which has a hollow (15) of a plate shape in the longitudinal direction so that the lead bar can be inserted into the hollow. The optimum shape of the fitting means is not to form a hollow fitting means but it is to form the structure shown in FIG. 5 by clading a thin plate of the fitting means on the lead bar by the hot diffusion pressure bonding method in view of easy fabrication. The pair of the sides which are perpendicular to the hollow direction, are preferably mounted on the pair of the electrodes by a welding or other method.

The composite electrodes are fixed to the frame at the ends of the fitting means. The lead bars are downwardly projected from the bottom of the lower frame and are connected to the bus bar at the outside of the frame whereby the pair of the electrodes are fixed with a specific space and the effective feeding of the current can be given. The space between the pair of the electrodes can be varied to a desired distance by varying a width of the fitting means, or varying a width of the reinforcing means if any. Since the pair of the electrodes are departed with a specific space, the space forms the passage for the solution of the electrolyzed product to rise and the gas lift effect of the gas generated by the electrolysis is given whereby the solution and gas of the electrolyzed products are lifted speedly. When holes are formed in the fitting means and the reinforcing means, the electrolyte can be flowed through these holes in the electrolyzing chamber whereby the flow of the electrolyte is not prevented.

When the shape of the lead bar is long plate shape to have substantially a sectional rectangular shape, a ratio of the peripheral length to the sectional area is larger than that of the sectional round shape. When they have the same sectional area and the same length, the lead bar having the sectional rectangular shape of the invention has larger contact area to the fitting means thereby lowering the electric resistance between the lead bar and the fitting means.

In the plate shape of the lead bar of the invention, the width of the lead bar can be larger by decreasing its thickness in comparison with the round rod having the same sectional area as the lead bar. When the lead bars having long width are arranged so that the longitudinal direction is substantially parallel to the flow of the solution and the width direction is substantially parallel to the flow of the solution, it is expected to attain advantage for reducing the disturbing of the flow of the solution.

On the other hand, when the flow of the solution is not disturbed in the electrolyzing chamber, in the case of round rod type lead bars, it is necessary to reduce the diameter of the round rod. When the diameter is reduced, the sectional area of the lead bar is reduced. In order to give same effect, number of the lead bars should be increased. This is troublesome in the fitting operation and the flow of the solution is disturbed in the electrolyzing chamber.

From the above-mentioned facts, it is clearly understood that the strap plate shape of the lead bar is remarkably advantageous and such shaped lead bar can be prepared by the hot diffusion press bonding to attain desired objects in view of characteristics, fabrication and economical aspect.

In accordance with the present invention, the lead bars and the electrode are mechanically and electrically connected through the fitting means. When the electrode should be repaired in its deterioration, the electrode can be disconnected by disconnecting the joints between the fitting means and the electrode. Since the electrode is not directly connected to the lead bars the damage of the expensive lead bars can be prevented in the disconnecting operation.

The substrate of the fitting means should have high electric conductivity and anticorrosive to the solution and the gas contacted with the fitting means. The fitting means for the anode can be substrates prepared by covering a chlorine resistant metal such as titanium on a substrate made of a metal such as copper and aluminum. On the other hand, the fitting means for the cathode can be substrates made of iron or stainless steel or prepared by covering an alkali resistant metal such as iron and stainless steel on a substrate made of a metal such as copper and aluminum.

EXAMPLE

Hollow rectangular pipes made of titanium (sectional view of 50 mm×50 mm×3 t) were assembled to form a rectangular frames as shown in FIG. 4 (2.1 m×1.1 m×0.05 m).

The longer sides of the frames were used as an upper frame and a lower frame. One side frame was used as a hollow passage for passing the electrolyte recycled from a gas-liquid separator into the lower frame. An inlet for feeding the electrolyte into the hollow part of the lower frame was connected to the lower frame and fine holes for feeding the electrolyte into the electrolyzing chamber from the hollow part of the lower frame are formed on the inner side surface of the lower frame and six holes for inserting lead bars were formed with substantially same space in the lower frame.

Also, fine holes for discharging the solution and the gas from the electrolyzing chamber into the hollow part of the upper frame, and an outlet for discharging the solution and the gas from the hollow part of the upper frame out of the frame are formed in the upper frame. An inlet for the electrolyte recycled from the gas-liquid separator is formed in the above-mentioned side frame.

Each flat plate of lead bar prepared by covering a copper substrate with titanium by the hot diffusion press bonding method (1.08 m×0.041 m×0.013 m) was inserted into six holes so that the flat planes of the lead bars were arranged to be parallel to the electrode and the flow of the electrolyte in the electrolyzing chamber is not prevented.

Each flat plate fitting means made of titanium (1.0 m×0.017 m×0.004 m) was fitted on the flat planes of each lead bar whereby the linear contacting parts to the lead bars in the vertical direction, were electrically and mechanically connected. Each reinforcing means made of titanium (1.0 m×0.047 m×0.004 m) was mounted between the adjacent lead bars at the center. A net type electrode made of titanium coated with ruthenium oxide (2.0 m×1.0 m) was mounted on the surfaces of the fitting means opposite to the lead bar connecting parts to prepare an anode compartment. Cathode compartments were prepared in accordance with the same structure except the frames were made of stainless steel; and the lead bars were prepared by coating stainless steel on copper substrates by the hot diffusion press bonding method and the fitting means, the reinforcing means and the electrode were made of stainless steel.

A plurality of cathode compartments and anode compartments and cation exchange membranes were alternatively arranged to hold the cation exchange membrane through flat gaskets made of EPDM having two lines of triangular projections thickness of the flat plate of 3.5 mm and height of projection of 3.5 mm between the anode compartment and the cathode compartment and the frames for the anode compartments and the cathode compartments were fastened to prepare a filter press type electrolytic cell. Each gas-liquid separation vessel for separating the gas and the solution discharged from the electrolyzing chambers, was disposed above the electrolytic cell and was connected to the anode side and also to the cathode side. The outlets of the upper frames and the inlets for passing the recycled electrolyte were respectively connected to the gas-liquid separation vessels with each flexible horses.

In the electrolyzing operation, the electrolyte was recycled through the gas-liquid separation vessel by the effect of lifting the gas generated in the electrolyzing chamber without forcible means.

REFERENCE

Each frames made of titanium having the same size and the same shape was prepared and the hollow passages in the frames were formed to give the same passages for the solution and the gas. However, only two holes for inserting the lead bar were formed in one side frame. Seventeen fitting means made of titanium in a flat plate shape having hollow for inserting the lead bar (1.0 m×0.047 m×0.004 m) were arranged in the vertical direction with substantially equal space.

Each lead bar prepared by coating titanium on a copper substrate by the hot diffusion press bonding process (2.30 m×0.153 m×0.018 m) was inserted through the holes formed in the side frame and the holes formed in the fitting means. The net type electrode made of titanium coated with ruthenium oxide (2.0 m×1.0 m) was mounted on the both side surfaces of the fitting means to prepare an anode compartment.

Cathode compartment were prepared to give the same size and the shape of the anode compartment of Reference except using the materials used for the cathode compartment of Example.

In accordance with the same process of Example, an electrolytic cell was prepared by using the above-mentioned anode compartments and cathode compartments and cation exchange membranes.

Each electrolysis was carried out by feeding 5.3 N-NaCl into the anode compartments and feeding water into the cathode compartments in each of the electrolytic cells of Example and Reference to obtain 12.7 N-NaOH. The current density was varied and electrolytic voltages were measured. Results are shown in Table 1.

TABLE 1

| Current Density (A/cm²) | | 15 | 20 | 25 | 30 |
|---|---|---|---|---|---|
| Example | Electrolytic voltage* | 3.11 V | 3.26 V | 3.41 V | 3.59 V |
| | Voltage loss of metal conductor | 0.14 V | 0.18 V | 0.23 V | 0.27 V |
| Reference | Electrolytic voltage* | 3.11 V | 3.28 V | 3.59 V | 3.92 V |
| | Voltage loss of metal conductor | 0.14 V | 0.17 V | 0.22 V | 0.26 V |

Note
*Voltage difference between anode and cathode

The voltage loss of the metal conductor in Example was substantially the same with that of Reference. However, the electrolytic voltage of Example was lower than that of Reference.

The result shows the fact that the electrolyzed product of the solution and the gas can be easily discharged from the electrolyzing chamber in the case of the present invention inserting the lead bars from the bottom of the lower frame in the vertical direction. Moreover, in Example, the total weight of the expensive lead bar can be reduced to about ¼ of that of Reference. Even though, the electrolysis was continued for about 18 months in Example, no leakage of the solution from the frames was not observed and no damage of the bus bars disposed below the frames was observed.

What is claimed as new and desired to be secured by Letters Patent of the United States is:

1. In an electrode compartment of an electrolyzing chamber surrounded by frame members, said electrode compartment comprising at least one lead bar for electrically connecting an electrode to a power source and an electrode held in communication with the lead bars, means for feeding an electrolyte in a lower frame member and means for discharging an electrolyzed product in an upper frame member to result in lifting flow of the electrolyte in the electrolyzing chamber, an improvement wherein said at least one lead bar is inserted through the bottom of said lower frame in the vertical direction and held substantially parallel to the upward flow of said electrolyte in the electrolyzing chamber and wherein said electrode is mechanically held by fitting means mounted on said at least one lead bar to thereby electrically connect said at least one lead bar to said electrode, and wherein said at least one lead bar is substantially quadrilateral in section and said fitting means include a quadrilateral hollow into which said at least one lead bar is inserted for continuous contct about the periphery of said lead bar.

2. An electrode compartment according to claim 1 wherein said lower frame is hollow to form a passage for feeding said electrolyte and includes means for feeding the electrolyte, said means for feeding comprising an inlet in said frame for feeding the electrolyte into the hollow of said lower frame and holes on said lower frame for feeding said electrolyte into said electrolyzing chamber; and said upper frame is hollow to form a passage for discharging the electrolyzed product and includes means for discharging the electrolyzed product, said means for discharging comprising holes on said upper frame for discharging the electrolyzed product into the hollow part and an outlet in said frame for discharging the electrolyzed product from the hollow of said upper frame.

3. In an electrode compartment of an electrolyzing chamber surrounded by frame members, said electrode compartment comprising at least one lead bar for electrically connecting an electrode to a power source and an electrode held on said lead bars, means for feeding an electrolyte in a lower frame member and means for discharging an electrolyzed product in an upper frame member to result in lifting flow of the electrolyte in the electrolyzing chamber, an improvement wherein the lead bars are inserted through the bottom of said lower frame in the vertical direction and held substantially parallel to the upward flow of said electrolyte in the electrolyzing chamber and wherein said electrode is mechanically held by fitting means mounted on said lead bars to thereby electrically connect said lead bars to said electrode, and wherein said fitting means is cross shaped in section and has a longitudinal hollow formed therein, said lead bar being surrounded by said hollow, and wherein the fitting means are arranged in the vertical direction and are substantially parallel to the lifting flow of the electrolyte in the electrolyzing chamber and one of said electrodes is mechanically held on each side surface of said fitting means to provide a space between the electrodes, and the electrodes are electrically connected to the lead bars by means of said fitting means.

4. An electrode compartment according to claim 1, or 3 wherein at least one reinforcing means having a plate shape is arranged between the lead bars and is substantially parallel to the lead bars in the electrolyzing chamber and an electrode is mechanically held on each side surface of the reinforcing means.

* * * * *